US007647650B2

(12) United States Patent
Chiang

(10) Patent No.: US 7,647,650 B2
(45) Date of Patent: Jan. 19, 2010

(54) SWIMMING GOGGLES

(76) Inventor: Herman Chiang, 11F-2, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 135 days.

(21) Appl. No.: 11/806,086

(22) Filed: May 30, 2007

(65) Prior Publication Data

US 2008/0263753 A1 Oct. 30, 2008

(30) Foreign Application Priority Data

Apr. 25, 2007 (TW) ..... 96206599 U

(51) Int. Cl.
*A61F 9/02* (2006.01)

(52) U.S. Cl. ..... 2/431; 2/426; 2/440; 2/442; 2/448; 2/452

(58) Field of Classification Search ..... 2/450, 2/426, 428, 440, 442, 445, 448; 351/43
See application file for complete search history.

(56) References Cited

U.S. PATENT DOCUMENTS 5,479,917 A * 1/1996 Hsieh ..... 128/200.29
5,711,035 A * 1/1998 Haslbeck ..... 2/436
6,349,419 B1 * 2/2002 Chiang ..... 2/428
6,349,420 B1 * 2/2002 Chiang ..... 2/428
6,405,384 B1 * 6/2002 Chiang ..... 2/428
6,532,603 B1 * 3/2003 Lan ..... 2/428
6,694,533 B2 * 2/2004 Chiang ..... 2/428
7,146,654 B2 * 12/2006 Chiang ..... 2/428
7,210,175 B2 * 5/2007 Chiang ..... 2/450

* cited by examiner

*Primary Examiner*—Gary L Welch
*Assistant Examiner*—Sally Colson Cline
(74) *Attorney, Agent, or Firm*—Cheng-Ju Chiang

(57) ABSTRACT

Swimming goggles include a couple of reticulate holding frames connected by a bridge, a couple of frames assembled in the reticulate holding frames, a couple of eyeglasses assembled in the frames, and fasteners. The reticulate holding frames are made of rigid material. Each reticulate holding frame forms a first and a second locking annulus corresponding to each other. Each reticulate holding frame defines an assembling opening in outward sides of the first and the second locking annulus. A first and a second connecting sheets respectively extend from opposing sides of the assembling opening and are assembled together when the swimming goggles are assembled. The frames are made of soft material and are assembled in the reticulate holding frames. The fasteners are assembled on the first and the second connecting sheets of the reticulate holding frames, and press the first and the second connecting sheets in a longitudinal direction and a transverse direction.

5 Claims, 4 Drawing Sheets

SWIMMING GOGGLES

BACKGROUND OF THE INVENTION

1. Field of the Invention

The present invention relates to swimming goggles, and particularly to swimming goggles which press frames, eyeglasses and pads together.

2. Related Art

Swimming goggles have a variety of shapes, and are generally classified as three sorts. The first sort of swimming goggles has eyeglasses integrated with frames (also called integrated type below); the second sort of swimming goggles has eyeglasses implanted into frames (also called implanted type below); and the third sort of swimming goggles has eyeglasses assembled onto mask pads and then assembled onto frames by fasteners (also called fastening type below). The fastening type of swimming goggles has frames made of rigid material, which takes up most of the whole swimming goggles in volume and in weight. So such swimming goggles can not decrease weight, making users wear uncomfortably.

Applicant has disclosed swimming goggles in Taiwan Utility Model Pat. No. 94203155, (corresponding to a U.S. application: U.S. patent Ser. No. 11/092,927, filed Mar. 30, 2005, entitled "Swimming goggles"), which solves the problem above. In Taiwan Utility Model Pat. No. 94203155, light rigid reticulate clipping frames are assembled to soft frames for reducing overall weight of the swimming goggles, whereby users wear well. Each rigid reticulate clipping frame consists of a couple of locking annuluses corresponding to each other, and a plurality of ribs connecting the locking annuluses. The ribs latch with a plurality of positioning grooves in the soft frames, and press to assemble reticulate clipping frames along with fasteners. The present invention addresses alternative swimming goggles which solve the problem above as well.

SUMMARY OF THE INVENTION

Accordingly, an object of the present invention is to provide swimming goggles which is an alternative fastening type of swimming goggles with reduced weight and which firmly assembles rigid reticulate holding frames to soft frames.

The swimming goggles of the present invention comprise a couple of reticulate holding frames, a bridge provided between the reticulate holding frames, a couple of frames, a couple of eyeglasses and fasteners. The reticulate holding frames are made of rigid material. Each reticulate holding frame forms a first locking annulus and a second locking annulus corresponding to each other. A plurality of ribs is provided between the first locking annulus and the second locking annulus, and connects the first locking annulus and the second locking annulus. Each reticulate holding frame defines an assembling opening in outward sides of the first locking annulus and the second locking annulus. A first connecting sheet and a second connecting sheet respectively extend from opposing sides of the assembling opening and are assembled together when the swimming goggles are assembled. The frames are made of soft material and are assembled in the reticulate holding frames. Each glass frame has an outward section and an inward section, and the inward section defines a receiving slot. The eyeglasses are assembled in the receiving slots of the frames. The fasteners are assembled on the first connecting sheets and the second connecting sheets of the reticulate holding frames, and press the first connecting sheets and the second connecting sheets in a longitudinal direction and a transverse direction The outward section of each glass frame forms an abutting flange for pressing the first locking annulus and the second locking annulus in longitudinal direction in assembly.

DESCRIPTION OF THE PREFERRED EMBODIMENTS

Figure 1:
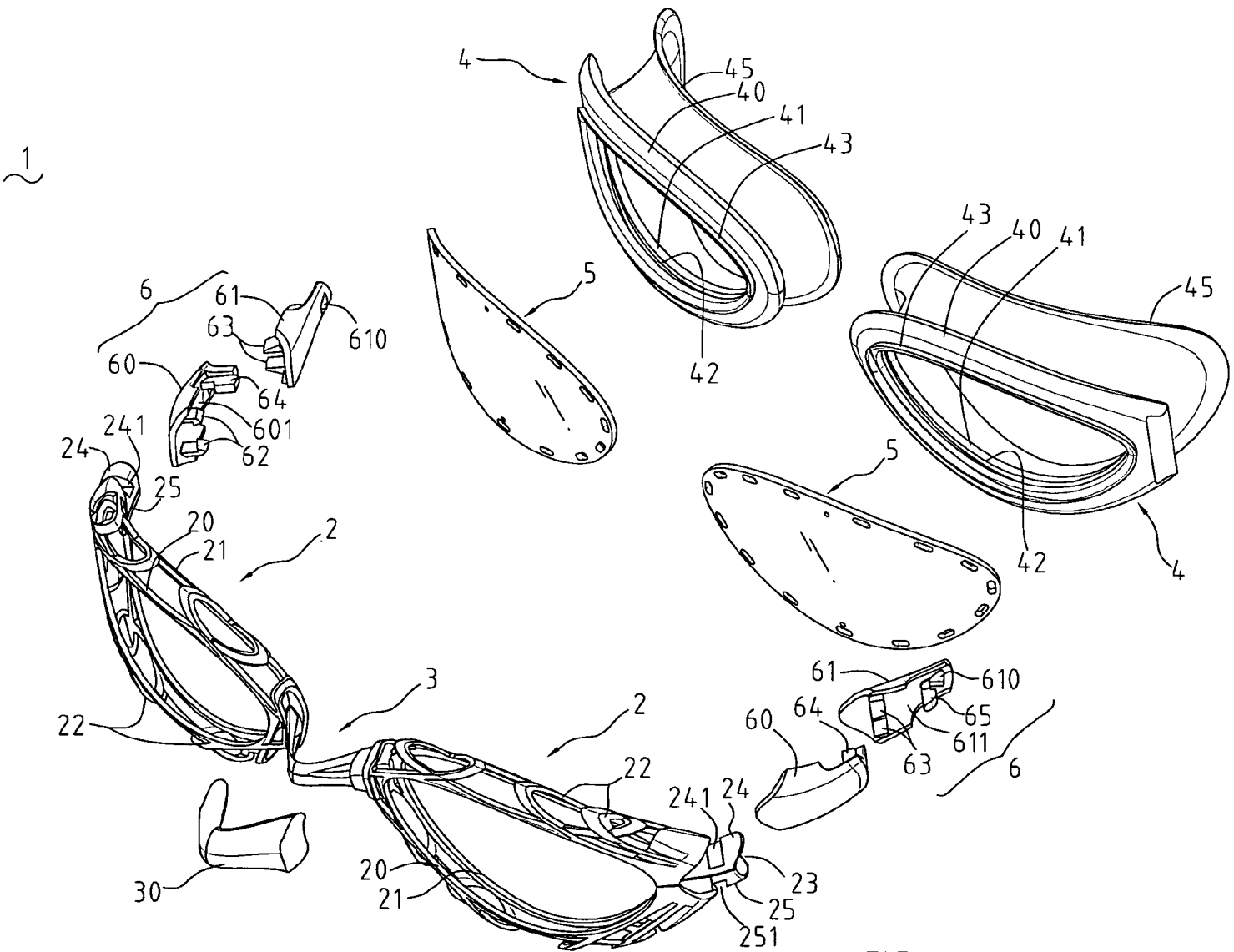
FIG. 1 is an exploded view of swimming goggles of the present invention.
Figure 2:
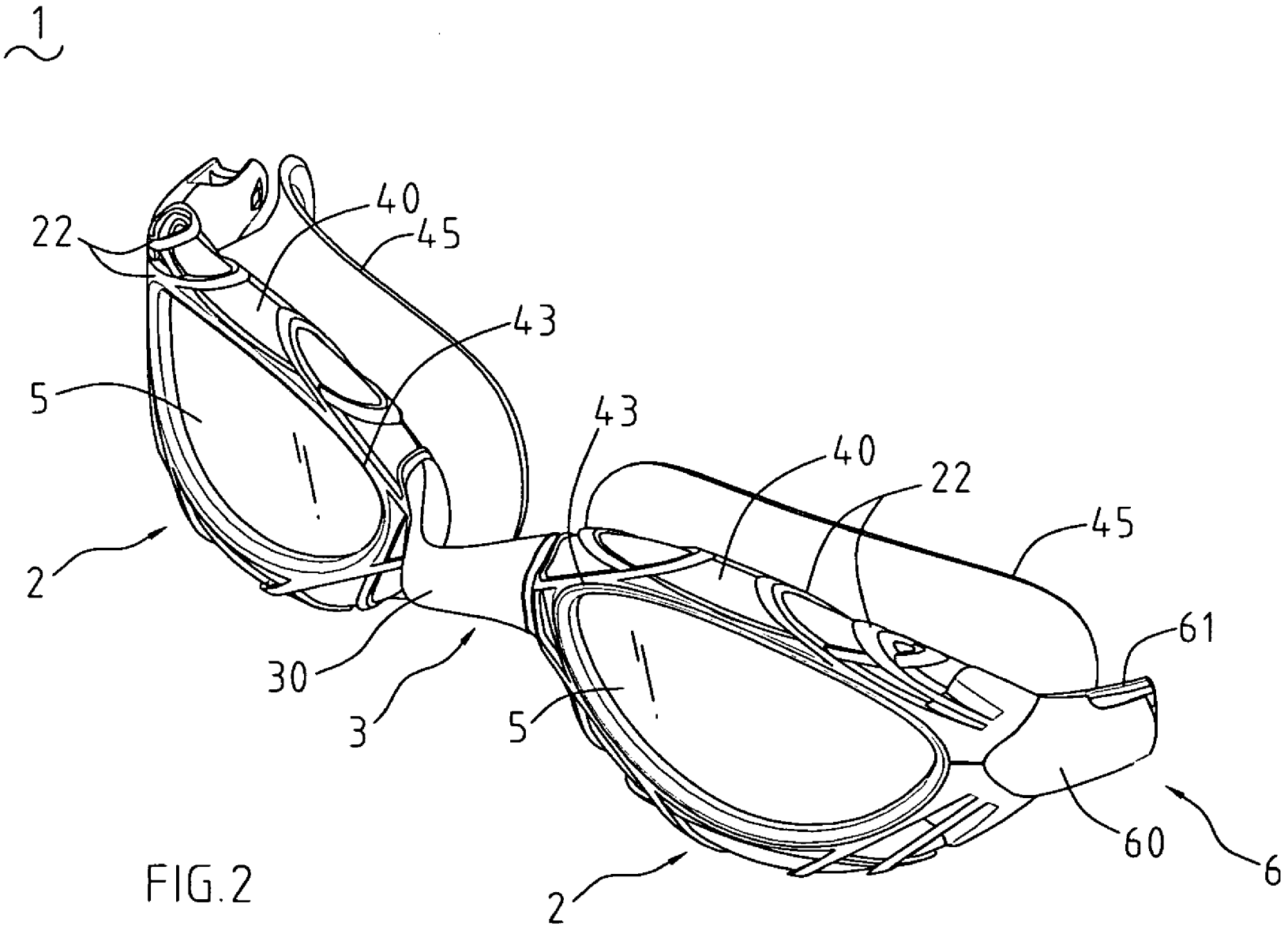
FIG. 2 is an assembled view of the swimming goggles of FIG. 1.
Figure 4:
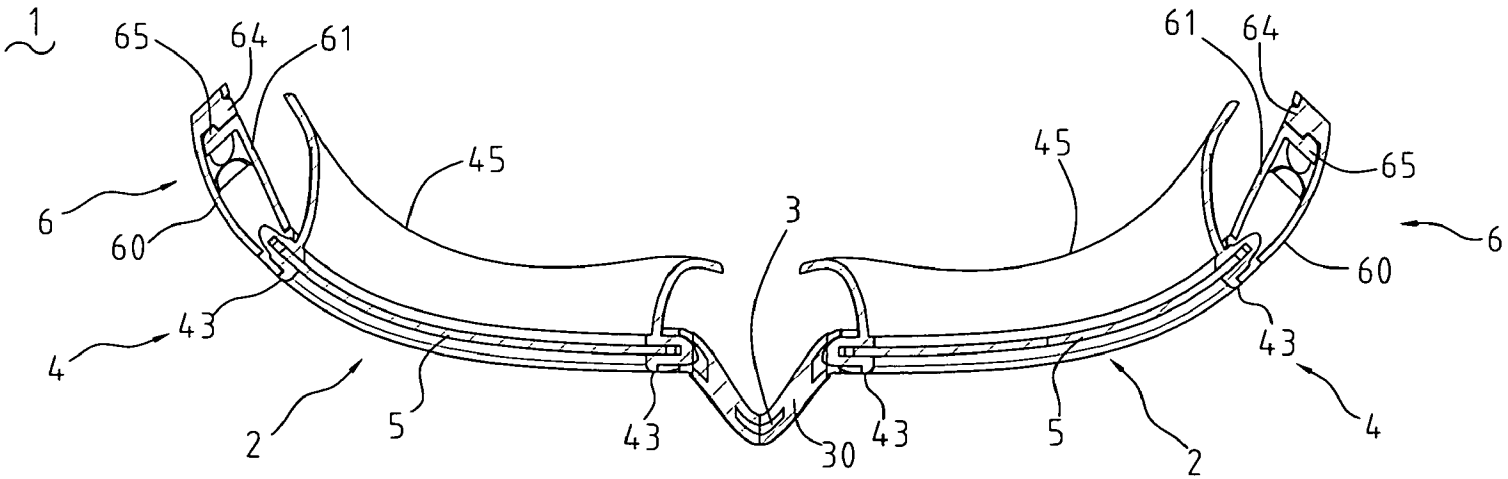
FIG. 4 is a cross-sectional view taken along the line 4-4 in FIG. 3.
Figure 3:
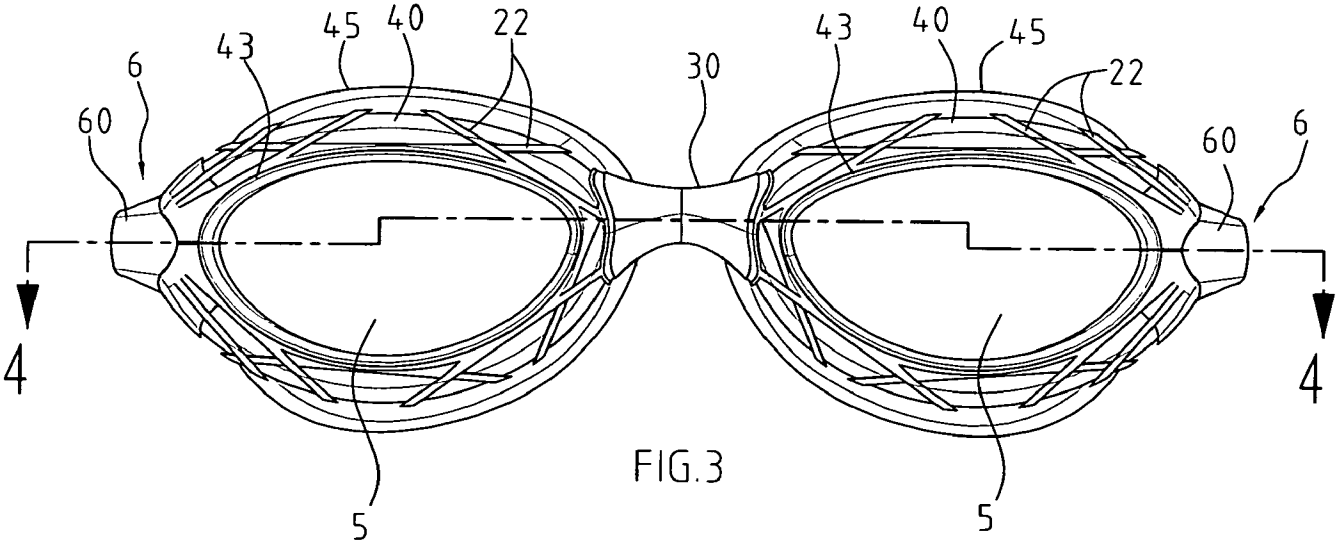
FIG. 3 is a front view of the swimming goggles of FIG. 2.
Figure 6:
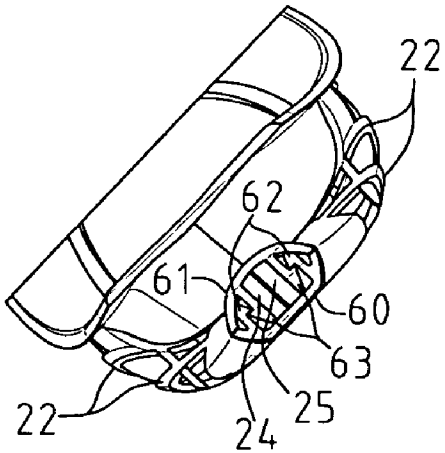
FIG. 6 is a cross-sectional view taken along the line 6-6 in FIG. 5.

Referring to FIGS. 1 and 2, swimming goggles 1 in accordance with the present invention comprise a couple of reticulate holding frames 2, a bridge 3 for connecting the reticulate holding frames 2, a couple of frames 4, a couple of eyeglasses 5 and fasteners 6. The reticulate holding frames 2 are made of rigid material. Each reticulate holding frame 2 forms a first locking annulus 20 and a second locking annulus 21 corresponding to each other. A plurality of ribs 22 is provided between the first locking annulus 20 and the second locking annulus 21 for connecting the first locking annulus 20 and the second locking annulus 21. Preferably, the ribs 22 are interlaced irregularly. In some embodiments, the ribs 22 are planar, three-dimensional, or mix planar and three-dimensional shapes, taking on special styles in appearance. Each reticulate holding frame 2 defines an assembling opening 23 in outward sides of the first locking annulus 20 and the second locking annulus 21. A first connecting sheet 24 and a second connecting sheet 25 respectively extend from opposing sides of the assembling opening 23 and are assembled together. Each first connecting sheet 24 defines a first positioning groove 241, and each second connecting sheet 25 defines a second positioning groove 251. The bridge 3 is provided between and is integrally formed with the two reticulate holding frames 2. A soft gasket 30 is integrally formed with the bridge 3 for providing comfortable feeling for a user's nose bridge.

The frames 4 are made of soft material and are respectively assembled in the reticulate holding frames 2. Each glass frame 4 has an outward section 40 and an inward section 41. The inward section 41 defines a receiving slot 42 for receiving an eyeglass 5 therein. During manufacturing, the eyeglasses 5 are implanted into the receiving slots 42 before the frames 4 are shaped, and then are integrally shaped with the frames 4. Each outward section 40 forms an abutting flange 43 for pressing the first locking annulus 20 and the second locking annulus 21 in longitudinal direction in assembly. A protective pad 45 integrally extends rearward from a rearward edge of each inward section 41 for providing comfortable wearing for users.

The fasteners 6 are assembled on the first connecting sheets 24 and the second connecting sheets 25 of the reticulate holding frames 2. Each fastener 6 includes a first cover 60 and a second cover 61 locking with each other. The first cover 60 and the second cover 61 allow head straps (not shown) to extend therethrough and position the head straps. The first cover 60 has a first bottom surface 601 forming a first latch 62 thereon. The second cover 61 has a second bottom surface 611 forming a second latch 63 thereon. The first latch 62 and the second latch 63 are both double hook-like, and lock with each other when assembled. In assembly, the first latch 62 and the second latch 63 are located in the first positioning groove 241 and the second positioning groove 251, pressing against the assembling opening 23 in a longitudinal direction, and clamping the first locking annulus 20 and the second locking annulus 21 retentively. The first cover 60 further forms a third latch 64, and the second cover 61 further forms a fourth latch 65. The third latch 64 and the fourth latch 65 are both single hook-like, and press the assembling opening 23 in a transverse direction. In assembly, the first latch 62 lock with the second latch 63, and the third latch 64 lock with the fourth latch 65, assembling the first cover 60 and the second cover 61 together. The first locking annulus 20 and the second locking annulus 21 engage with each other tightly, retaining the eyeglasses 5 onto the frames 4.

Figure 5:
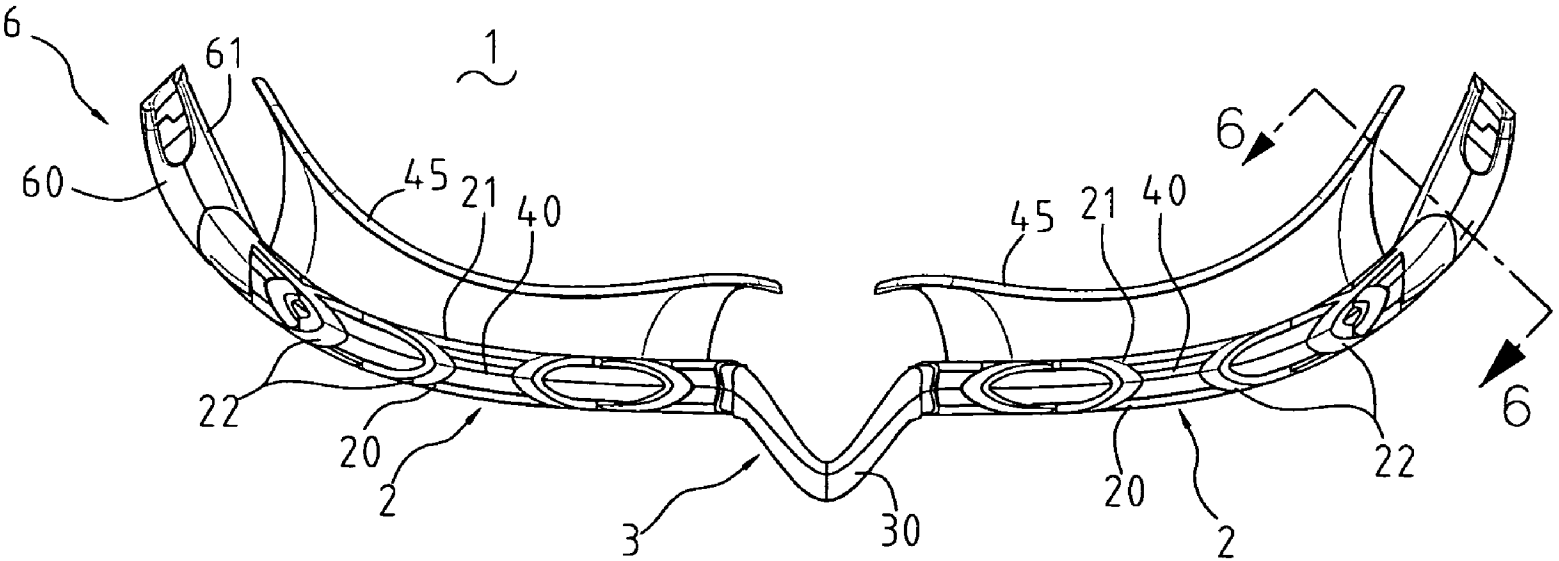
FIG. 5 is a top view of the swimming goggles of FIG. 2.

In assembly, with reference to FIG. 1 and FIGS. 3 to 6, the eyeglasses 5 are respectively assembled to the receiving slots 42 of the frames 4. The soft frames 4 are assembled to the reticulate holding frames 2 through the assembling openings 23. When assembled, the outward sections 40 of the frames 4 slide smoothly into the first locking annulus 20 and the second locking annulus 21 owing to arcuate surfaces of the frames 4, as shown in FIG. 5. The first locking annulus 20 and the second locking annulus 21 of the reticulate holding frames 2 press the abutting flanges 43 in a longitudinal direction. The first locking annulus 20 and the second locking annulus 21 receive the frames 4 therebetween and press the abutting flanges 43 in a longitudinal direction. Referring to FIGS. 1 and 5, the second latches 63 of the second covers 61 are extended along the first positioning grooves 241 and the second positioning grooves 251. The first latches 62 of the first covers 60 lock with the second latches 63 of the second covers 61. By this means, the first connecting sheets 24 and the second connecting sheets 25 are gradually pressed in a longitudinal direction to engage with each other tightly. Also referring to FIG. 4, the third latches 60 of the first covers 60 and the fourth latches 65 of the second covers 61 lock with each other. By this means, the first connecting sheets 24 and the second connecting sheets 25 are gradually pressed in a transverse direction to engage with each other tightly. The first covers 60 and the second covers 61 are assembled together, and therefore the frames 4 and the eyeglasses 5 are assembled reliably. Generally speaking, the first latches 62 and the second latches 63 press in a longitudinal direction, meanwhile the third latches 64 and the fourth latches 65 press in a longitudinal direction. The first locking annulus 20 and the second locking annulus 21 press the abutting flanges 43. Therefore the frames 4 and the eyeglasses 5 are assembled reliably. The frames 4 are made of soft material, and the reticulate holding frames 2 are light in weight, reducing the overall weight of the swimming goggles to provide light and comfortable wearing.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles comprising:

a pair of reticulate holding frames made of rigid material, each of the pair of reticulate holding frames forming a first locking annulus and a second locking annulus corresponding to each other, a plurality of ribs being provided between the first locking annulus and the second locking annulus for connecting the first locking annulus and the second locking annulus, each of the pair of reticulate holding frames having an assembling opening formed in an outwardly facing side of each of the first locking annulus and the second locking annulus, each of the pair of reticulate holding frames having a first connecting sheet and a second connecting sheet respectively disposed on opposing sides of the assembling opening;

a bridge provided between the pair of reticulate holding frames;

a pair of lens frames made of soft material and respectively assembled in the pair of reticulate holding frames, each lens frame having an outward section and an inward section, the inward section having a receiving slot formed therein, an outward section of each of the pair of lens frames forming an abutting flange for engagement with a corresponding one of the first locking annulus and the second locking annulus;

a pair of eyeglass lenses respectively assembled in the receiving slots of the lens frames; and a pair of fasteners respectively assembled on the first connecting sheets and the second connecting sheets of the pair of reticulate holding frames, and pressing the first connecting sheets and the second connecting sheets in two directions, each of the pair of fasteners include a first cover and a second cover that lock with each other and which allow a head strap to extend therethrough and position the head strap, the first cover having a first latch formed thereon and the second cover having a second latch formed thereon, the first latch and the second latch clampingly press the first connecting sheet and the second connecting sheet together in a first direction to close the assembling opening, the first cover further having a third latch formed thereon and the second cover further having a fourth latch formed thereon, the third latch and the fourth latch pressing the first connecting sheet and the second connecting sheet in a direction transverse to the first direction, the first latch having a pair of hook-shaped structures disposed in spaced relationship and the second latch having a pair of hook-shaped structures disposed in spaced relationship for locking engagement with the pair of hook-shaped structures of the first latch, the third latch and the fourth latch each having a hook-shaped structure for locking engagement therebetween, the first latch, the second latch, the third latch and the fourth latch together both tightly clampingly close the assembling opening and secure the first cover and the second cover together, wherein each first connecting sheet has a first positioning groove formed therein and each second connecting sheet has a second positioning groove formed therein corresponding to the first latch and second latch, the eyeglass lenses and lens frames being thereby held tightly together in the reticulate holding frames by the first and second latches pressing the first connecting sheet and the second connecting sheet in the first direction and by the third and fourth latches pressing the first connecting sheet and the second connecting sheet in the transverse direction.

2. The swimming goggles as claimed in claim 1, wherein the ribs are interlaced irregularly.

3. The swimming goggles as claimed in claim 2, wherein the ribs are planar, three-dimensional, or irregularly mix planar and three-dimensional shapes.

4. The swimming goggles as claimed in claim 1, wherein the bridge is integrally formed with the reticulate holding frames, a soft gasket being integrally formed with the bridge.

5. The swimming goggles as claimed in claim 1, wherein a protective pad extends integrally from a rearward edge of the inward section of each of the pair of lens frames.

* * * * *